US008820200B1

(12) United States Patent
Quinn

(10) Patent No.: US 8,820,200 B1
(45) Date of Patent: Sep. 2, 2014

(54) MODULAR DIE SYSTEM

(76) Inventor: Robert Richard Quinn, Washington Township, Macomb County, MI (US)

( * ) Notice: Subject to any disclaimer, the term of this patent is extended or adjusted under 35 U.S.C. 154(b) by 755 days.

(21) Appl. No.: 12/800,432

(22) Filed: May 14, 2010

Related U.S. Application Data

(60) Provisional application No. 61/217,139, filed on May 27, 2009.

(51) Int. Cl.
*B26D 1/00* (2006.01)

(52) U.S. Cl.
USPC ..... 83/13; 83/102; 83/104; 83/532

(58) Field of Classification Search
USPC ..... 83/13, 531, 532, 698.71, 698.91, 102, 83/104, 109, 559; 72/449–448, 404, 413, 72/455, 456; 76/107.1
See application file for complete search history.

(56) References Cited

U.S. PATENT DOCUMENTS

| | | | | |
|---|---|---|---|---|
| 3,150,550 | A * | 9/1964 | Berlin et al. | 83/13 |
| 3,602,079 | A * | 8/1971 | Carlson | 83/67 |
| 3,880,038 | A * | 4/1975 | Mangos | 83/685 |
| 3,908,500 | A * | 9/1975 | Gargrave et al. | 83/699.41 |
| 6,477,930 | B1 * | 11/2002 | Sandford | 83/162 |
| 6,520,900 | B1 * | 2/2003 | Sandford | 493/373 |
| 6,708,858 | B2 * | 3/2004 | Oetlinger | 225/104 |
| 7,578,223 | B2 * | 8/2009 | Bliss | 83/532 |
| 2008/0202190 | A1 * | 8/2008 | Boersma | 72/343 |

OTHER PUBLICATIONS

McKechnie et al. (Eds.), Webster's New Universal Unabridged Dictionary, Second Edition, Dorset & Baber, 1983, pp. 949 and 2101.
McKechnie et al. (Eds.), Webster's New Universal Unabridged Dictionary, 2nd Edition, Dorset & Baber, Cleveland, Ohio, 1983, p. 715 (force).
Oberg et al., Machinery's Handbook, 15th Edition, The Industrial Press, New York, New York, 1956, p. 296.

* cited by examiner

*Primary Examiner* — Phong Nguyen
(74) *Attorney, Agent, or Firm* — Christopher John Rudy

(57) ABSTRACT

Modular die set includes upper die shoe; lower die shoe, which has a first length, width, and thickness, and which is provided with an opening spanning a substantial, extensive portion of the first length and width of the lower die shoe, such that material can pass freely through the opening the first thickness of the lower die shoe and pass through the lower die shoe; and set of plural movable supports, which can be closely spaced or spaced apart in relation to one another, which can be selected and stationed to support a tooling subassembly and avoid any hole(s) in a lower tooling plate of the tooling subassembly such that scrap and/or parts to fall through the hole(s) can fall through the opening of the lower die shoe. The modular die can be mounted within a press, and parts made therewith.

20 Claims, 17 Drawing Sheets

ModDie-843

STEPS NOT NECESSARILY CONDUCTED IN SERIES:

PROVIDE DIE SET, WHICH INCLUDES LOWER DIE SHOE WITH SUBSTANTIAL AND EXTENSIVE OPENING THERETHROUGH

↓

PROVIDE TOOLING SUBASSEMBLY WITH LOWER TOOLING PLATE, WHICH MAY HAVE HOLE(S) FOR SCRAP AND/OR PARTS TO PASS THROUGH IN OPERATION

↓

MOUNT THE TOOLING SUBASSEMBLY, WITH THE LOWER TOOLING PLATE MOUNTED ON THE LOWER DIE SHOE AND COVERING AT LEAST PART OF THE OPENING OF THE LOWER DIE SHOE

↓

PROVIDE SET OF PLURAL MOVABLE SUPPORTS, AND SELECT FROM THE PLURAL MOVABLE SUPPORTS AN OPERATIONAL SET OF PLURAL MOVABLE SUPPORTS TO SUPPORT THE LOWER TOOLING PLATE AND AVOID ANY HOLE(S) IN THE LOWER TOOLING PLATE -- OPTIONALLY AT A SET UP STATION SPACED APART FROM A PRESS WHERE THE DIE IS EVENTUALLY PLACED

↓

STATION THE OPERATIONAL SET OF PLURAL MOVABLE SUPPORTS AT THE DIE SO AS TO BE IN A POSITION UNDER THE LOWER TOOLING PLATE OF THE TOOLING SUBASSEMBLY TO SUPPORT AND ALLOW ANY SCRAP AND/OR PARTS TO PASS THROUGH ANY HOLE(S) IN THE LOWER TOOLING PLATE, THROUGH THE OPENING IN THE LOWER DIE SHOE, WHEN THE DIE IS OPERATED -- AGAIN, OPTIONALLY AT THE SET UP STATION

↓

PROVIDE PRESS AND MOUNT THE DIE WITH OPERATIONAL SUPPORTS THEREIN

↓

OPERATE PRESS, FEEDING WORKPIECE THROUGH THE DIE, TO MAKE PARTS

FIG. 28

MODULAR DIE SYSTEM

This claims benefit under 35 USC 119(e) of provisional patent application No. 61/217,139 filed on May 27, 2009 A.D. The entire specification of that application, of course, including drawings, is incorporated herein by reference.

FIELD AND PURVIEW OF THE INVENTION

This concerns a device for die stamping, and its use. The same incorporate device modularity. The same may be used in connection with progressive dies, carrierless progressive dies, transfer dies, line dies, draw dies, and so forth and the like.

BACKGROUND TO THE INVENTION

In typical known die stamping operations, a die set includes an upper die shoe and a lower die shoe. Tooling is provided in the upper and lower die shoes specific for the parts that are to be stamped or otherwise worked on with the die set. When a run of different parts is to be made, a new die must be procured. Generally, the die set, made up of the upper and lower die shoes, upper and lower parallels, pins and bushings accounts for some 10~15% of the cost of the price of the stamped product, which in today's highly competitive market can be the difference between a viable operation or loss of a contract to an overseas supplier.

Adaptability has been introduced to a limited extent in some die sets. These put scrap and part outfall openings in the lower die shoe to accommodate scrap and parts for closely related parts and are restricted to stamping part families. For other parts not of the family, a different die set must be procured.

In some cases, a die set is provided with and attached to a large adaptor plate to attempt to enable quick die change systems. However, these large adaptor plates traditionally offset any savings for the intended purpose of the quick die change, and make for inefficient die storage.

The industry, thus, is concerned with lowering set up times. All other things being equal, a shorter set up time translates into more efficient production, and hence, lower product cost. All other things, however, are not always equal. And so, certain solutions for lowering set up times cost so much in capital outlay that what they save in lowering set up times they lose in monetary expense to procure, or worse, they end up actually increasing the cost of final product beyond what may be saved in lowering the set up times.

It would be desirable to lower final costs in die stamping work. It would be desirable to provide the art alternative(s).

SUMMARY OF THE INVENTION

In general, provided hereby is a modular die set, which comprises:

an upper die shoe;

a lower die shoe, which has a first length, width, and thickness, and which is provided with an opening spanning a substantial, extensive portion of the first length and width of the lower die shoe, and with said opening such that material can pass freely through the opening the first thickness of the lower die shoe and thus pass through the lower die shoe; and a set of plural movable supports, which can be closely spaced or spaced apart in relation to one another, which can be selected and stationed to support a tooling subassembly and to avoid any hole(s) in a lower tooling plate of the tooling subassembly such that scrap and/or parts to fall through the hole(s) can fall through said opening of the lower die shoe.

The modular die set can be provided with the tooling subassembly, which includes an upper tooling plate and a lower tooling plate with a second length, width, and thickness, for mounting under the upper die shoe and upon the lower die shoe, and covering at least a portion of said opening of the lower die shoe, so as to make up a modular die. The modular die can be mounted within a press, and parts made therewith. The modular die can be set up at a set up station spaced apart from the press, where plural movable supports can be arranged and selected for moving to the device to be stationed as the set of plural movable supports for support of the tooling plate of the device. A method or process for making parts comprises the following steps, which are not necessarily conducted in series:

providing the aforesaid die set with the upper and lower die shoes; providing the tooling subassembly, and mounting it on the upper and lower die shoes; providing the set of plural movable supports, selecting from among them an operational set of plural movable supports for supporting the lower tooling plate of the tooling subassembly and avoiding any hole(s) therein, and stationing the operational set of plural movable supports under the lower tooling plate such that the lower tooling plate is supported and any scrap and/or parts can pass through any hole(s) in the lower tooling plate and pass through said opening in the lower die shoe—and thus providing a die;

providing a press, and mounting the die within the press, optionally employing a set up station; and providing a workpiece, and feeding the workpiece through the die in the press while operating the press to make parts from the workpiece.

The invention is useful in making die stamped parts.

Significantly by the invention the art is advanced in kind. Actual costs in die stamping work can be significantly lowered, and the art is provided with alternative(s). More particularly, among advantages that can be provided hereby are the following:

Immediate reduction of tooling price by some 10~15%.

Very quick die change enabled with:

no additional cost per tool;

big, inefficient adaptor plates for every die not needed.

Easier storage of dies, with less storage space required.

Faster die build times, with less waiting than with big die shoes.

Reduced die price, thus creating market advantage for higher "jobs won" percentage.

Adaptable to many modes of operation: progressive, carrierless progressive, transfer, line and draw dies, and other systems—thus further improving the piece price, further producing a higher "jobs won" percentage.

Numerous further advantages attend the invention.

DRAWINGS IN BRIEF

The drawings form part of the specification hereof. With respect to the drawings, which are not necessarily drawn to scale, the following is briefly noted:

FIG. 1 is a top perspective view of a die set with tooling of the prior art, embodied here as a progressive die.

FIG. 2 is a front plan view of the die of FIG. 1.

FIG. 3 is a top perspective plan view of a small progressive die attached to an adaptor plate.

FIG. 4 is a top perspective view of a tooling subassembly, which can be found with the present modular die system.

FIG. 5 is a front plan view of the subassembly of FIG. 4.

FIG. 6 is a top perspective view of the tooling subassembly of FIG. 4, combined with a lower die shoe hereof so as to make a subcombination hereof.

FIG. 7 is a front perspective view of the subcombination of FIG. 6.

FIG. 8 is a front perspective view of the subcombination of FIG. 6, along with all of its movable supports.

FIG. 9 is a top perspective view of an upper die shoe in combination with the subcombination of FIGS. 6 and 9.

FIG. 10 is a front plan view of the combination of FIG. 9.

FIG. 11 is a side plan view of a lower die shoe with plural movable supports as may be found in FIG. 8, which shows details of a support to shoe latching pin and a tooling subassembly clamping mechanism, and which makes a subcombination hereof.

FIG. 12 is a top plan view of the lower die shoe with plural movable supports as found or employed in FIG. 10.

FIG. 13 is a side plan view of the subcombination of FIG. 11.

FIG. 14 is a top plan view of the subcombination of FIG. 11, which is mounted in combination with a press.

FIG. 15 is a top plan view of the combination of FIG. 9, found at a set up station ready for set up.

FIG. 16 is a front plan view of the situation of FIG. 15.

FIG. 17 is a front plan view of the combination of FIG. 9, and with the die being removed from the set up station.

FIG. 18 is a top plan view of the set up station found within FIGS. 15-17, with unused movable supports in place thereat.

FIG. 19 is a front plan view of the situation of FIG. 18.

Figure 9:
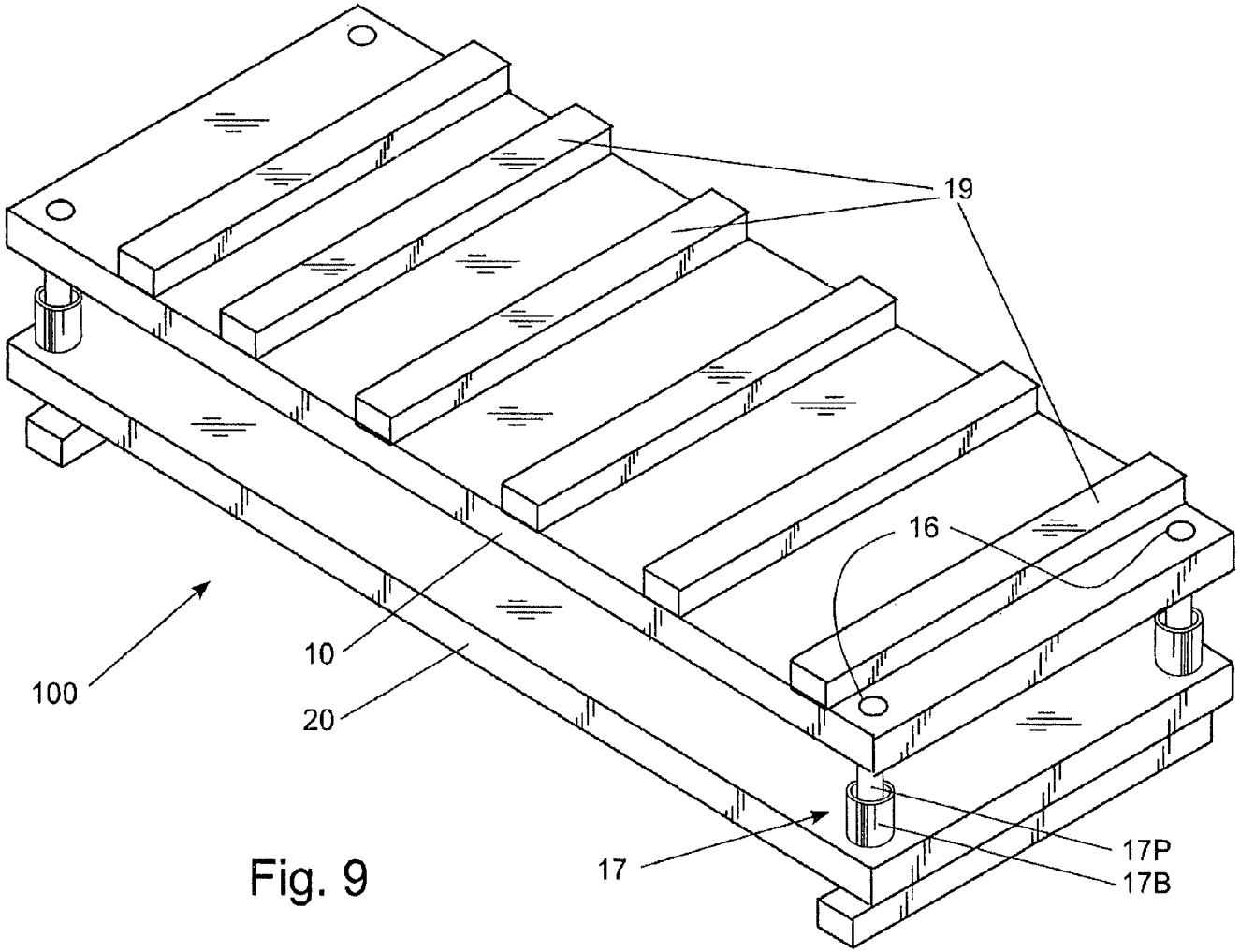
Figure 10:
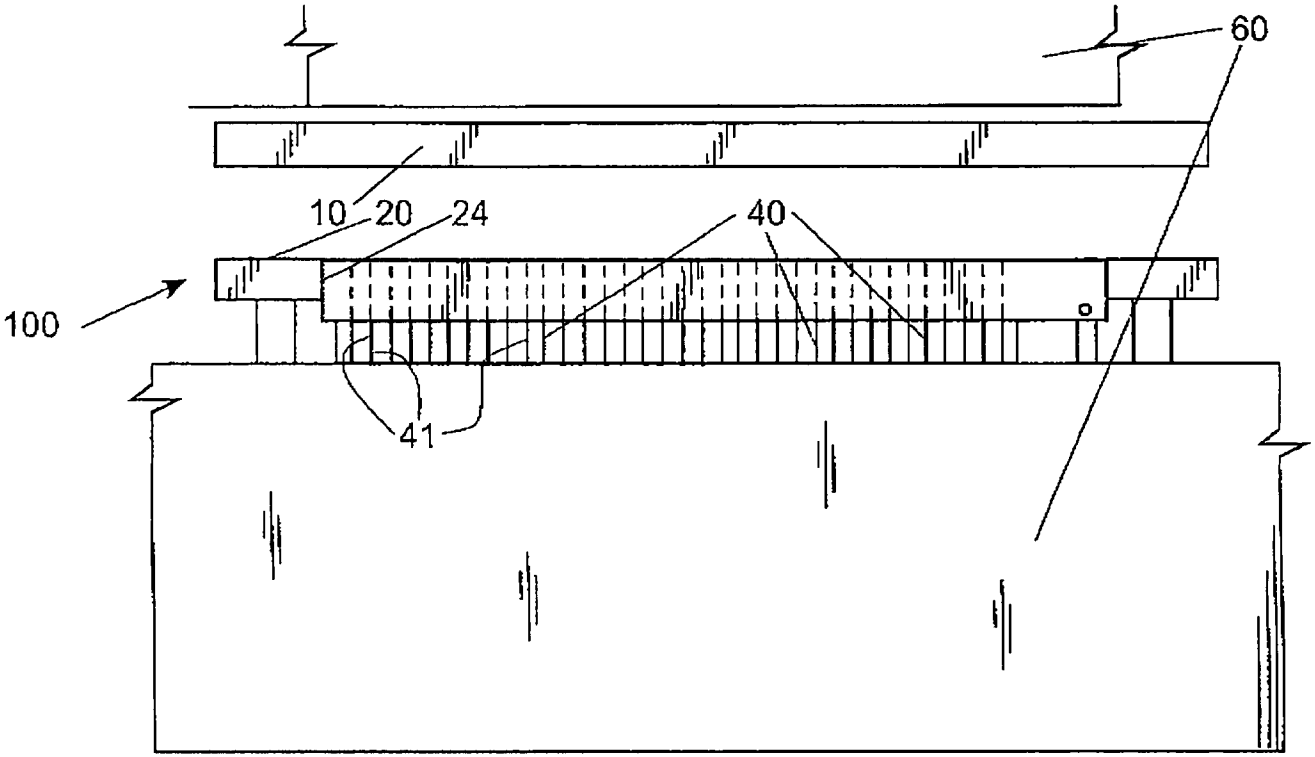
Figure 11:
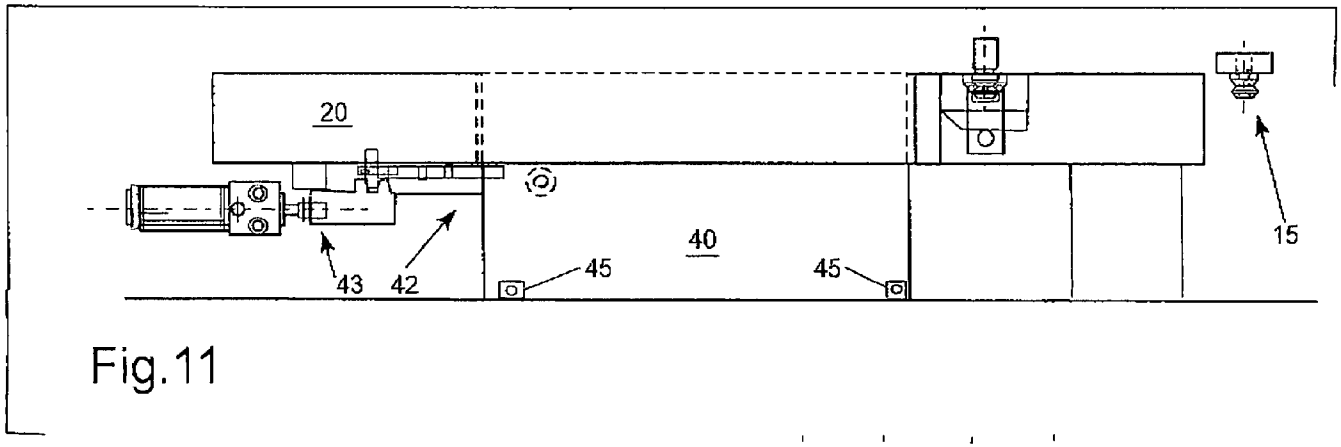
Figure 12:
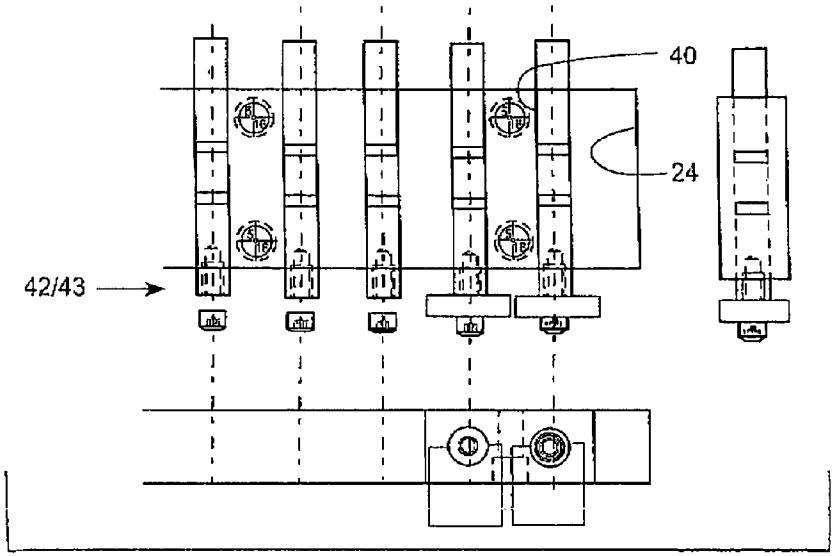
Figure 13:
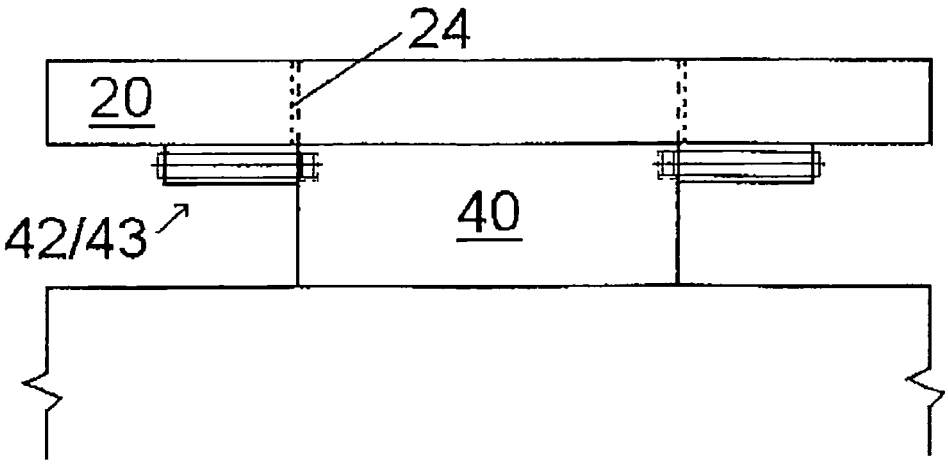
Figure 14:
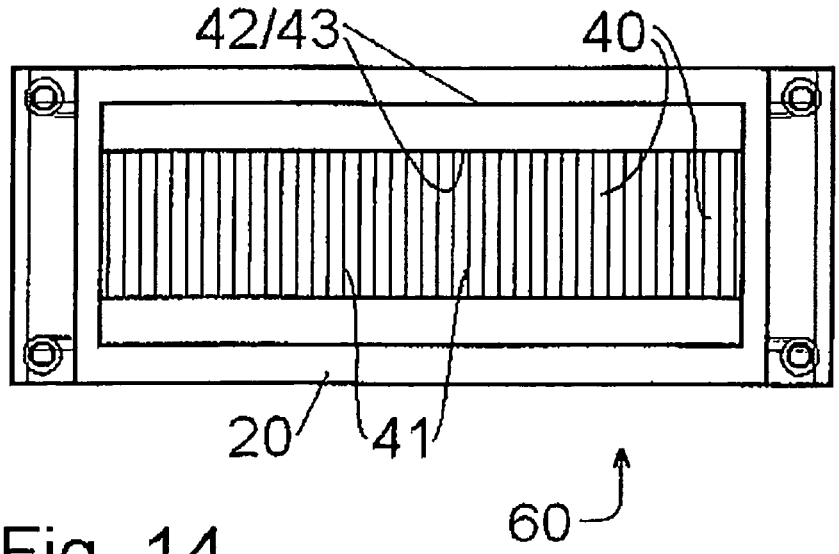
Figure 15:
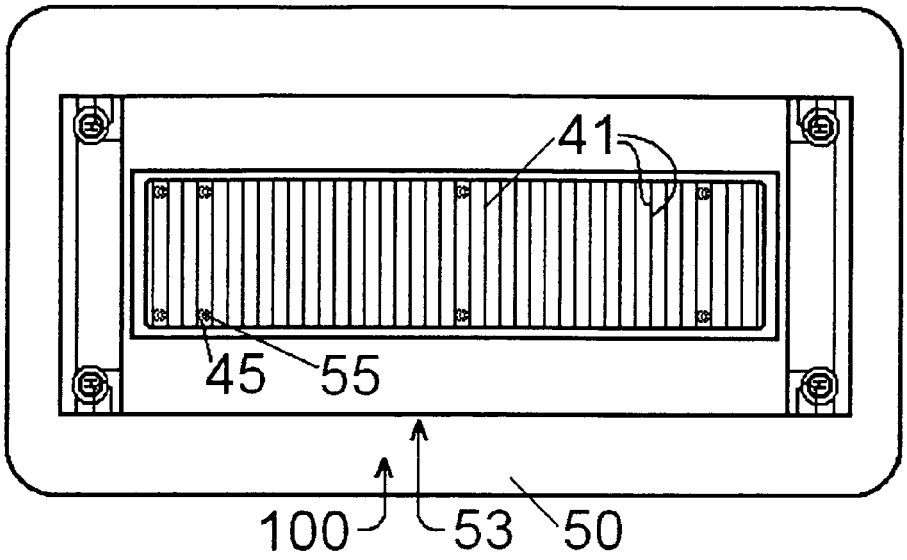
Figure 16:
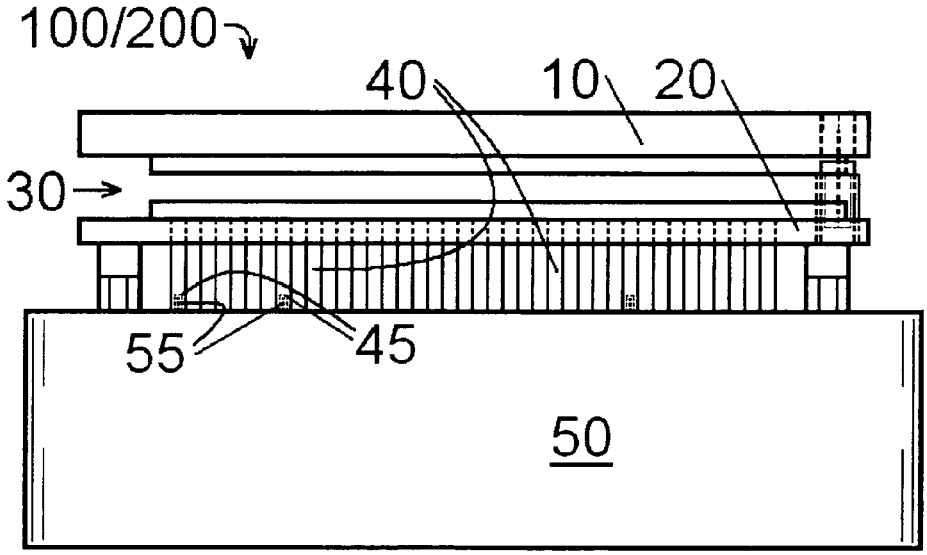
Figure 17:
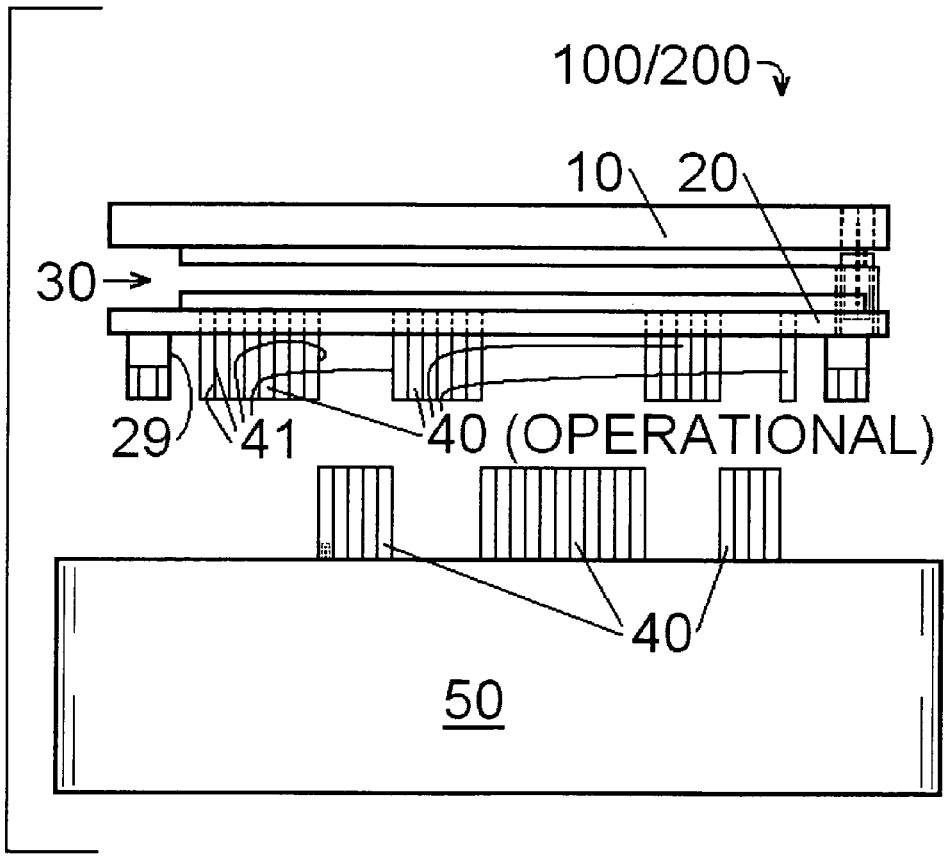
Figure 18:
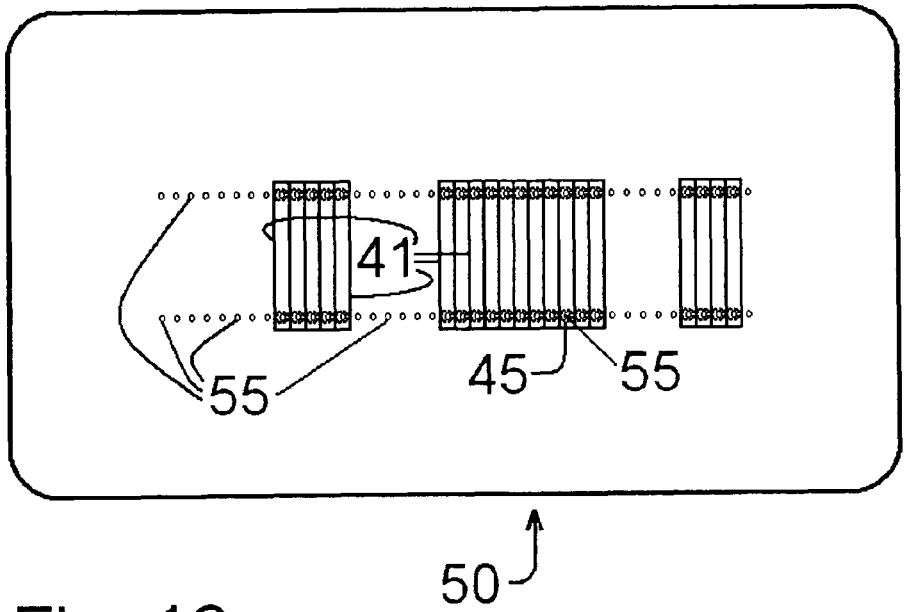
Figure 19:
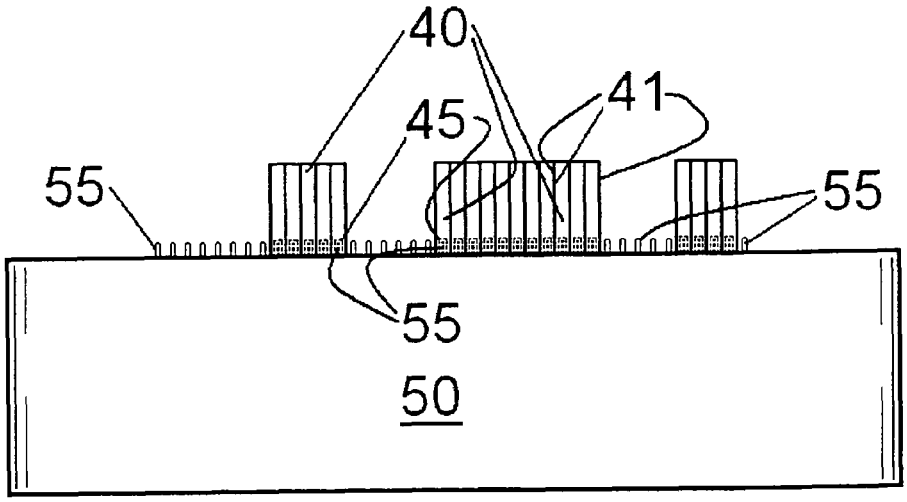
Figure 20:
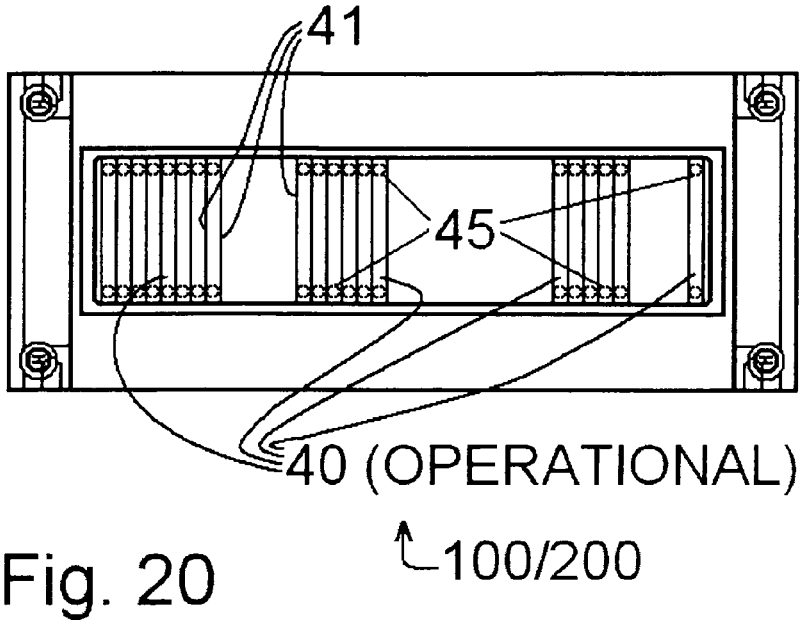

FIG. 20 is a top plan view of the combination of FIG. 9 after its removal from the set up station found within FIGS. 15-19 and with its plural movable supports arranged with some stationed to support the tooling subassembly from underneath through its lower tooling plate, and others taken away to avoid holes in the lower tooling, plate such that scrap and/or parts can fall through the hole(s) and through the opening of the present lower die shoe.

Figure 21:
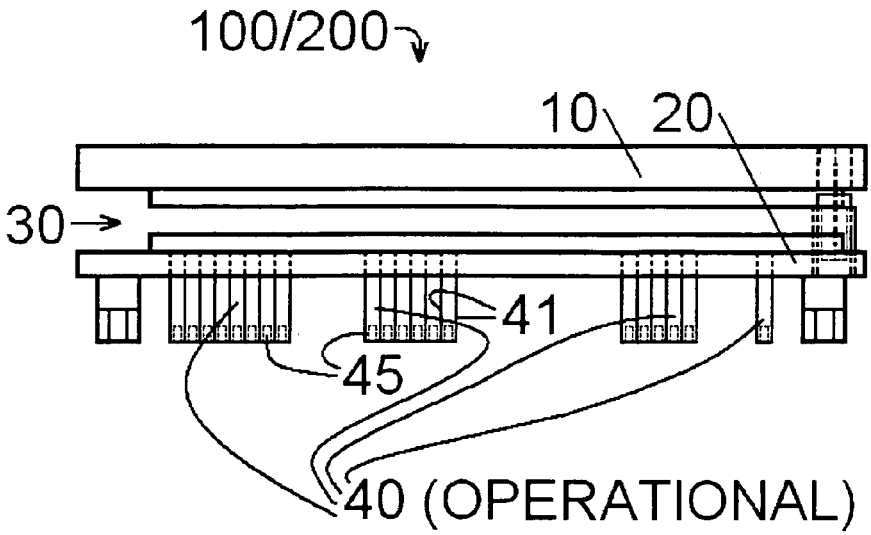
Figure 22:
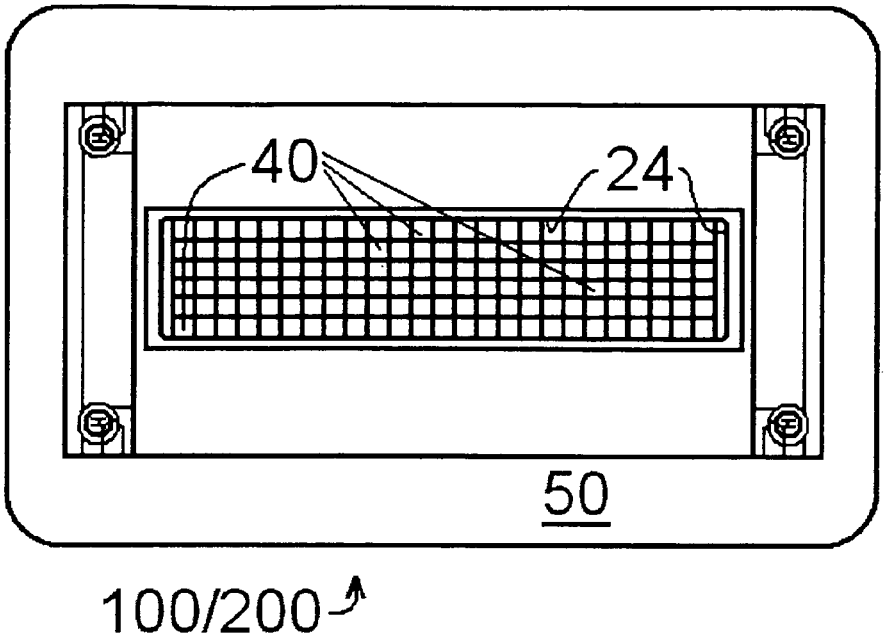

FIG. 21 is a front plan view of the situation of FIG. 20.

Figure 23:
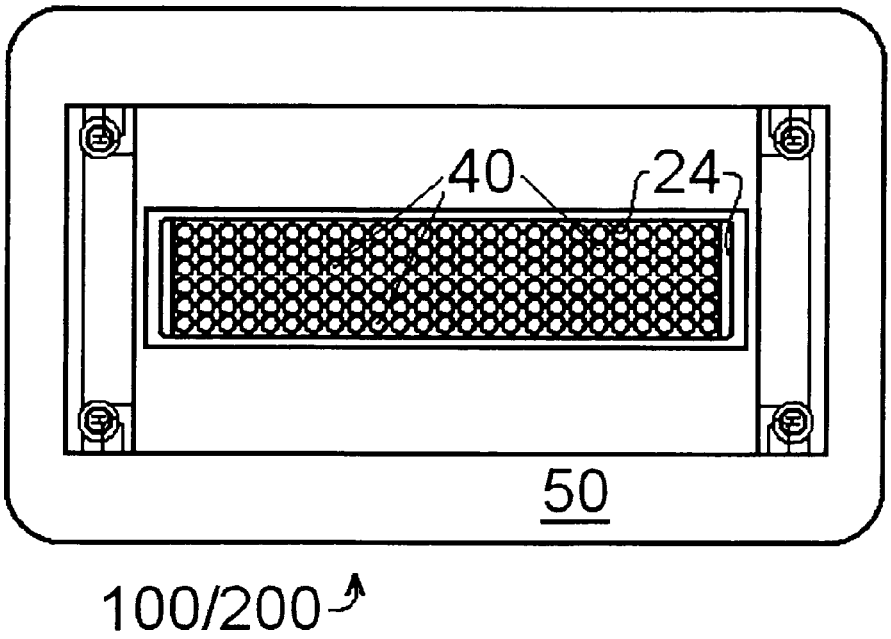
Figure 24:
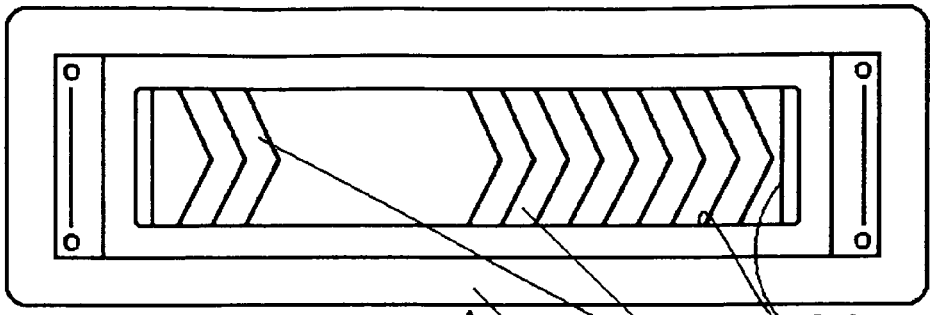
Figure 25:
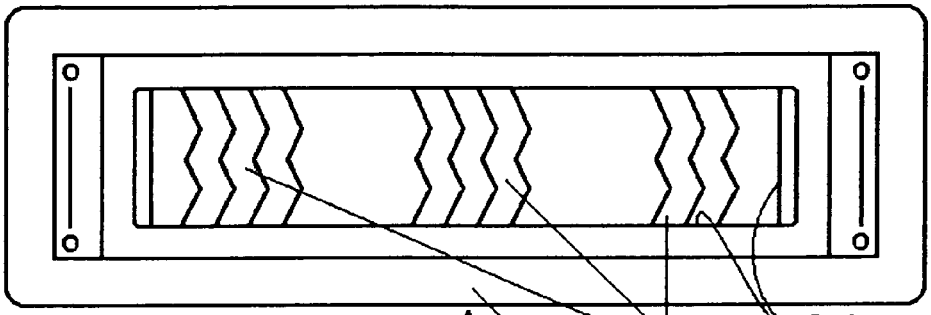
Figure 26:
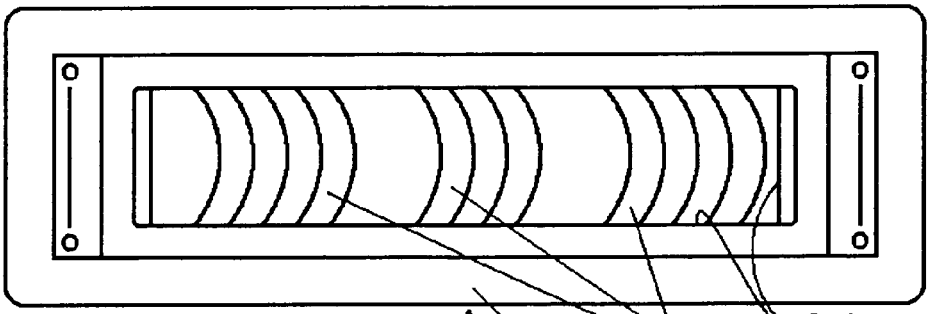
Figure 27:
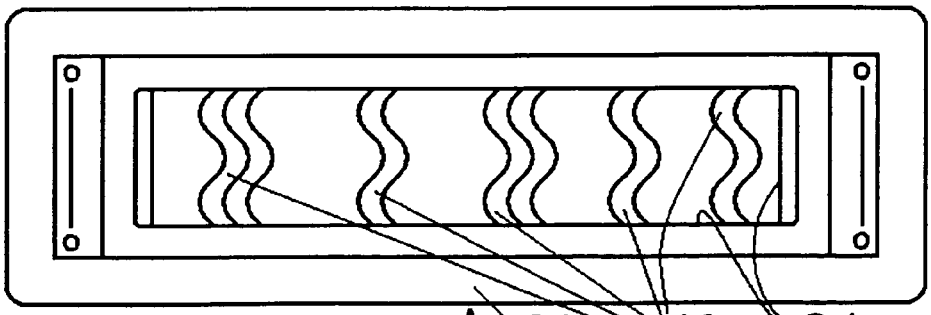

FIGS. 22-27 are top plan views of combinations such as that of FIG. 9 such as found at a set up station ready for set up, but having rectangular or square movable supports in a "checkerboard" configuration and array (FIG. 22); elliptical or cylindrical movable supports in a "checkerboard" configuration and array (FIG. 23); V-shaped movable supports (FIG. 24); zigzag shape movable supports (FIG. 25); crescent shape movable supports (FIG. 26); and serpentine shape movable supports (FIG. 27).

FIG. 28 is a flow chart of use of the modular die system.

ILLUSTRATIVE DETAIL

The invention can be further understood by the detail set out below, which may be read in view of the drawings. Such is to be taken in an illustrative and not necessarily limiting sense.

The present modular die set has upper and lower die shoes. The present system may be employed with progressive, carrierless progressive, transfer, line, draw and so forth dies. It can be made to be of any suitable size and shape.

The present lower die shoe is provided with an opening spanning a substantial and extensive portion of the length and width of the lower die shoe. Material can pass freely through that opening and through the lower die shoe.

There is also provided a set of plural movable supports. The plural movable supports can be closely spaced with respect to one another, and can be selected and stationed to support a tooling subassembly through its lower tooling plate and to avoid any of such hole(s) in the lower tooling plate so that the scrap and/or parts can fall through the hole(s) and the corresponding portion of the opening of the lower die shoe.

For die stamping operation, there is also provided the tooling subassembly peculiar to the part or family of parts that are to be made. The tooling subassembly, among other components, has the lower tooling plate, which is for mounting on the lower die shoe and covering at least a portion of the opening of the lower die shoe. The lower tooling plate may be provided with hole(s) at predetermined location(s) for scrap and/or parts to fall through as manufacture of a particular part may require. Through an upper tooling plate the tooling subassembly can be mounted to the upper die shoe.

A set up station can be spaced apart from the die and press.

Any suitable material may be employed to make the present modular tooling system. In general, for example, a mild, unhardened, prehardened or hardened steel may be employed.

Figure 1:
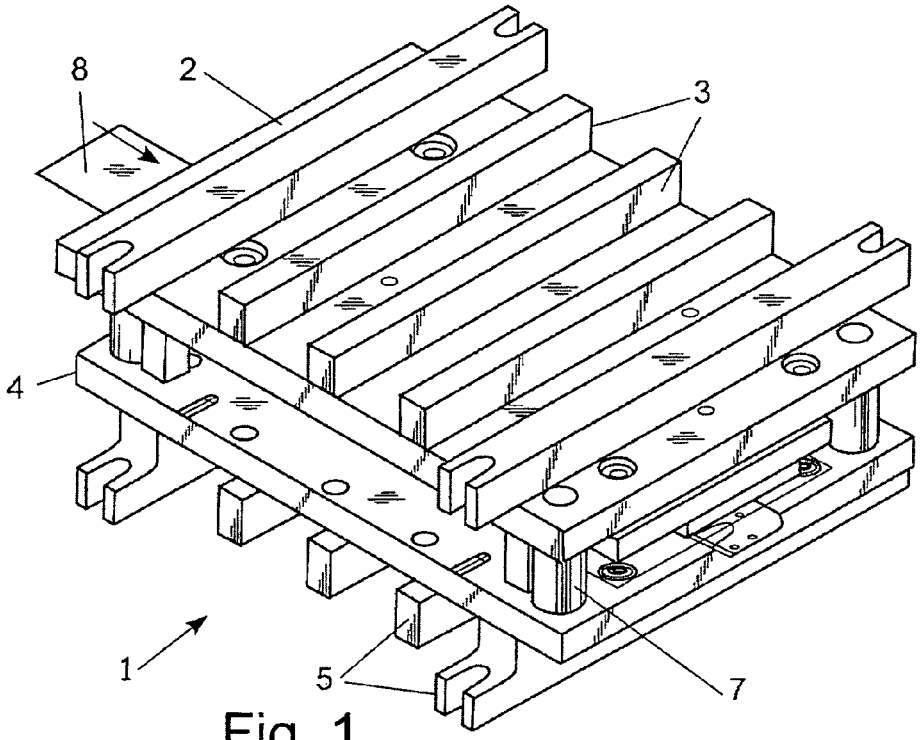
Fig. 1 (PRIOR ART)
FIGS. 1-3 represent prior art. Regarding the same, the following is noted.
Figure 2:
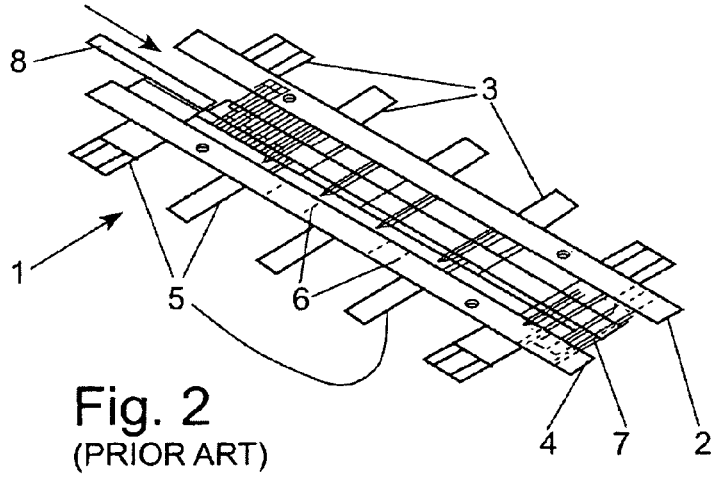
Fig. 2 (PRIOR ART)
Figure 3:
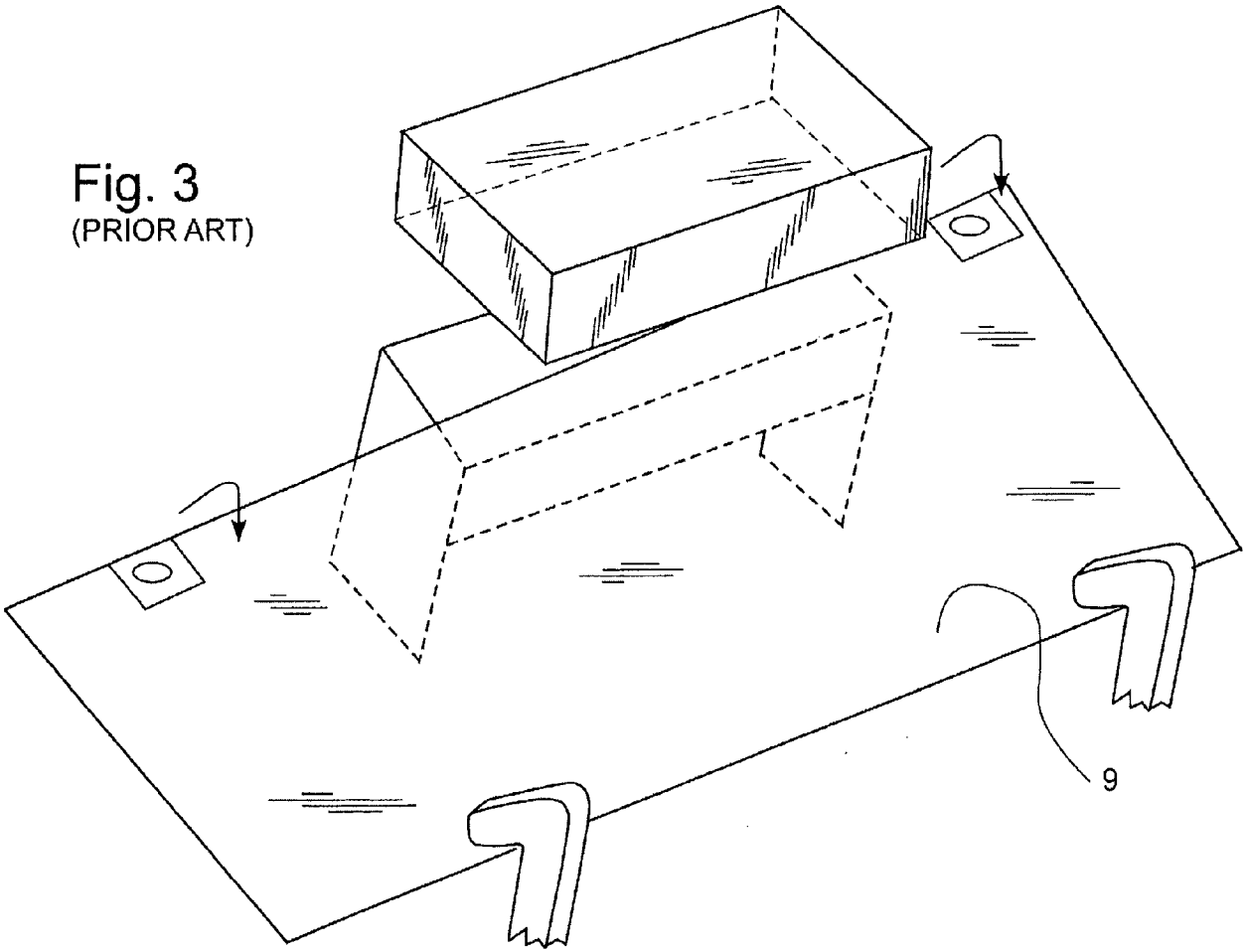
Fig. 3 (PRIOR ART)

With respect to the drawings, the following is noted:

In particular reference to FIGS. 1-3, prior art systems can include well known features such as follows:

| FEATURE NUMBER | COMMENT |
|---|---|
| 1 | Die set |
| 2 | Upper die shoe |
| 3 | Upper parallels |
| 4 | Lower die shoe |
| 5 | Lower parallels |
| 6 | Fixed openings in lower die shoe for scrap and/or parts to fall through |
| 7 | Pin and bushing set, for example, ball bearing or slip fit bronze style |
| 8 | Workpiece |
| 9 | Adapter plate with clamps to hold plate with die to lower bolster plate in press. |

Figure 4:
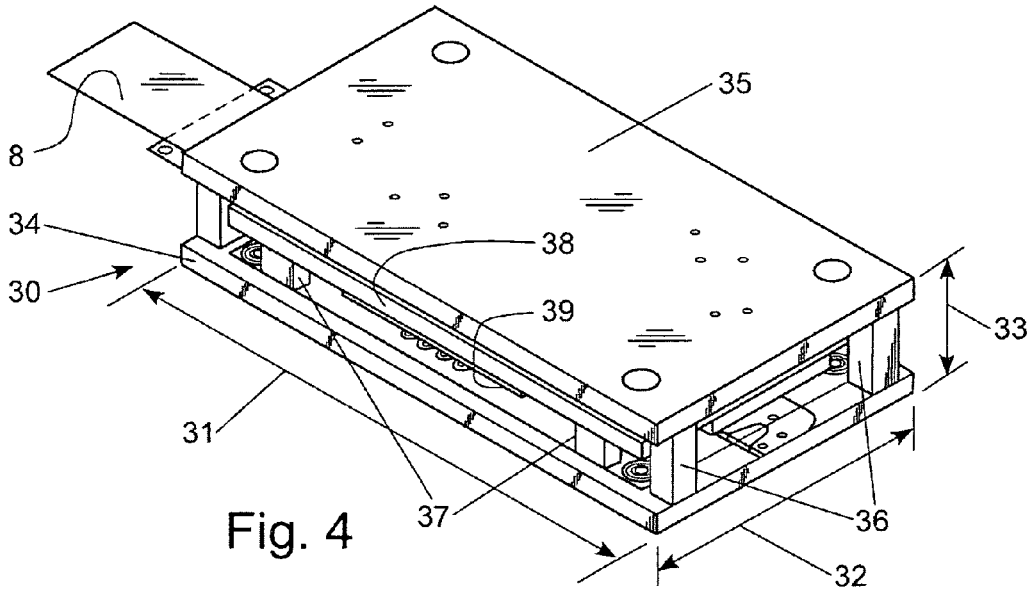
FIGS. 4-24 represent illustrative embodiments of the present modular die system, portions thereof or combinations therewith. Regarding the same, the following is noted.
Figure 5:
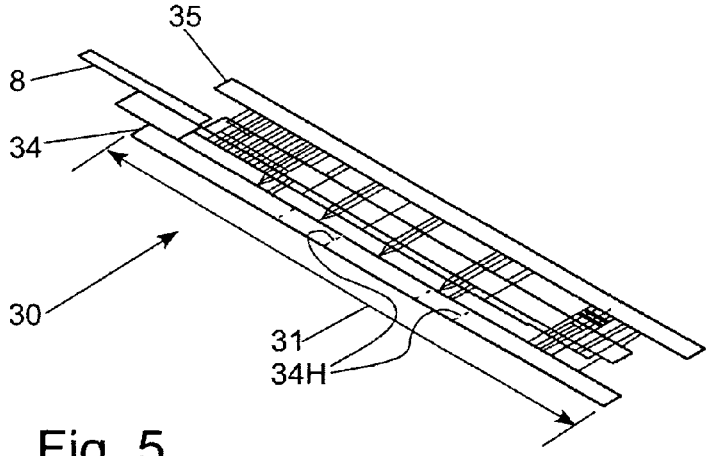
Figure 6:
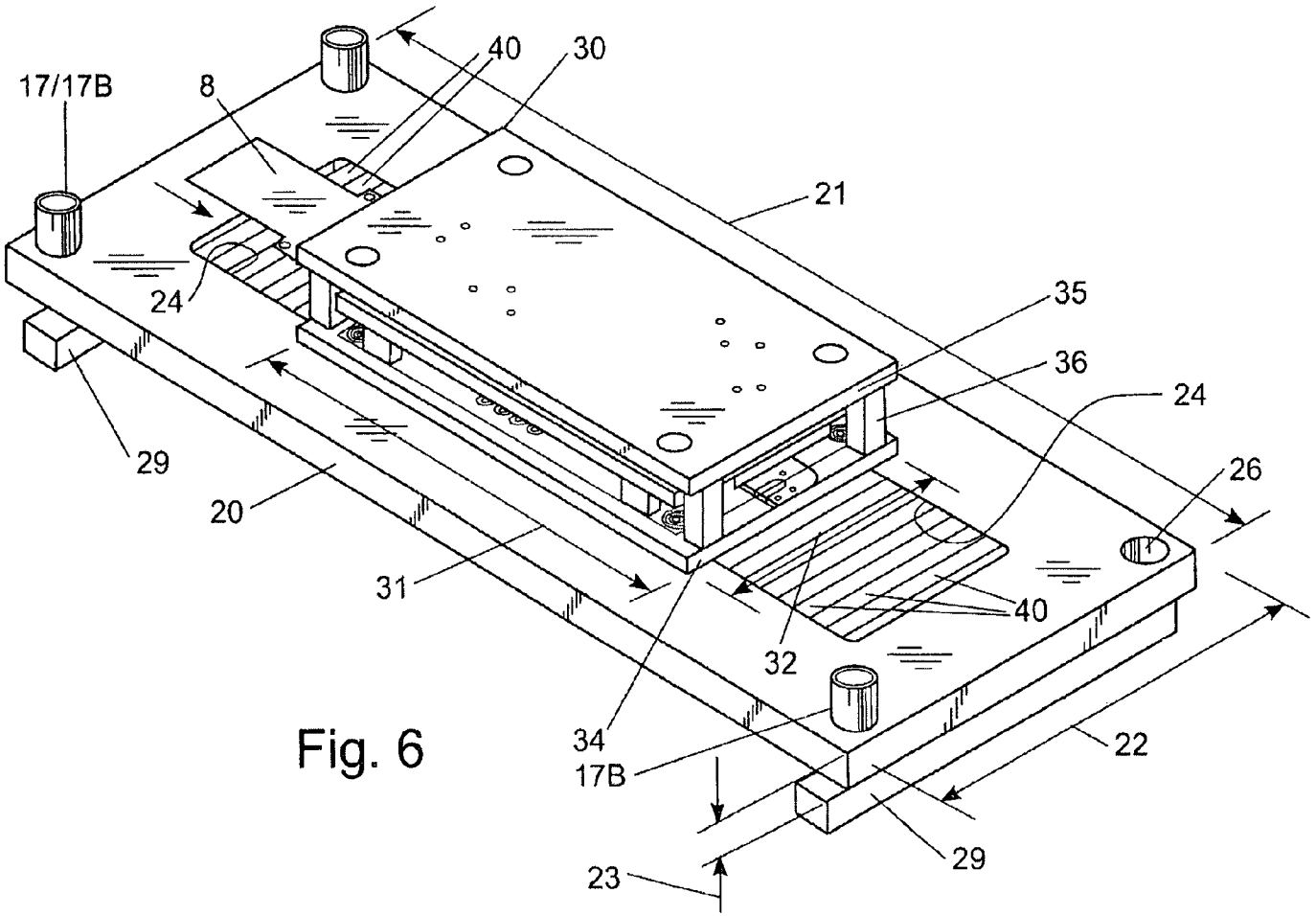
Figure 7:
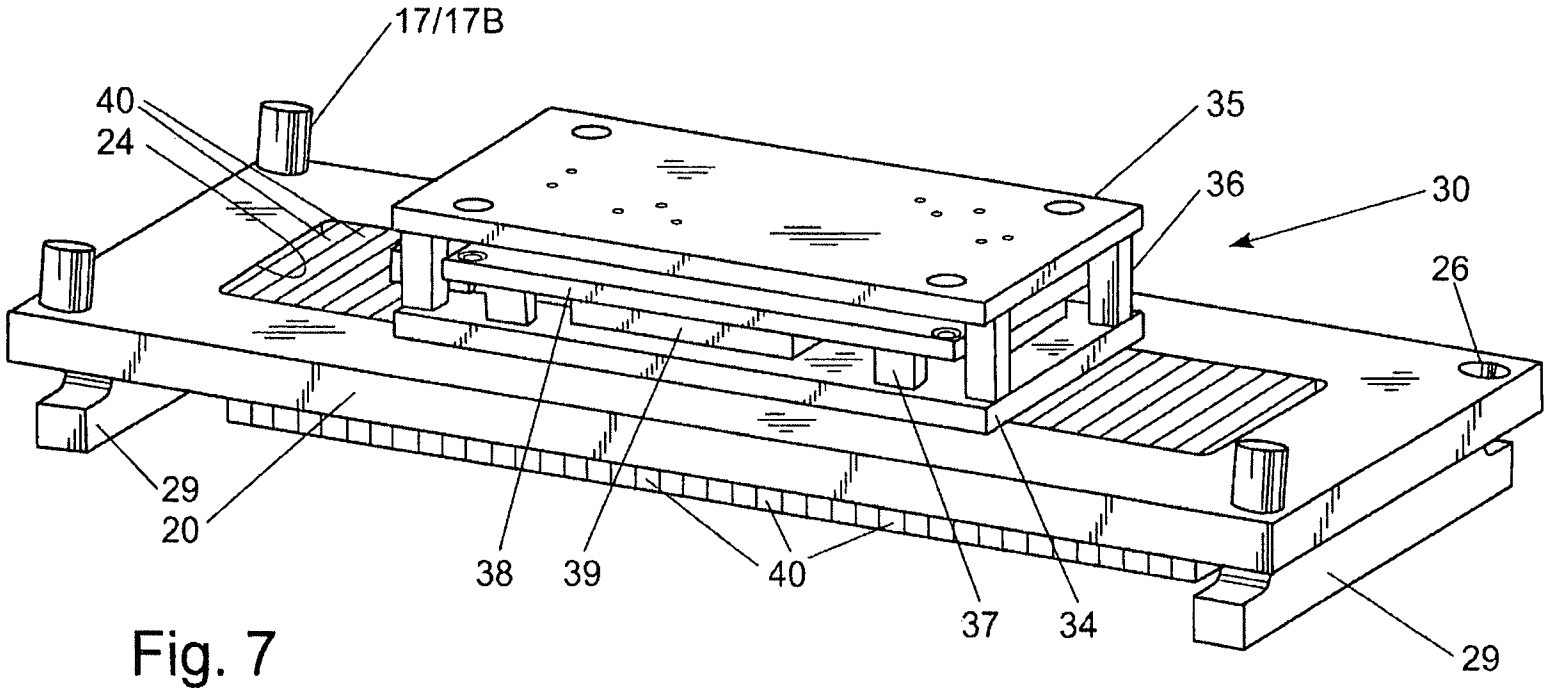
Figure 8:
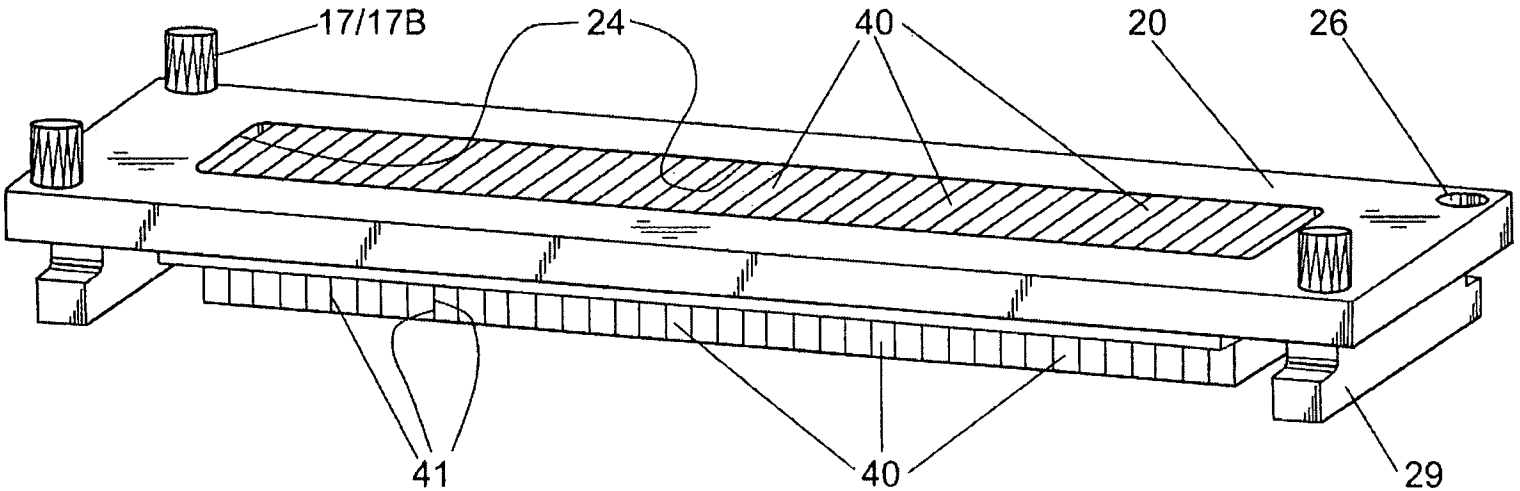

In particular reference to FIG. 4 et seq., modular die set 100 can be further equipped with tooling to form modular die 200. The die set 100 includes upper and lower die shoes 10, 20.

The upper die shoe 10, say, made of unhardened or prehardened steel, can include stud-receiving portion 15 of a clamping mechanism and pin holes 16 for pin and bushing movable connectors 17 for connecting the upper die shoe 10 with the lower die shoe 20. The movable connectors 17, for example, of the ball bearing or slip fit bronze style, generally include bushings 17B and pins 17P, with the pin holes 16 accommodating the pins 17P. Also, a set of permanent mounting paralells 19 may be provided.

The lower die shoe 20, say, made of unhardened or prehardened steel, has length 21, say, about from twenty to one hundred twenty inches, for example, about sixty inches; width 22, say, about from ten to sixty inches, for example, about thirty inches; and thickness 23, say, about from one and one half of an inch to six inches, say, about two and one half inches. Opening 24 spans a substantial, extensive portion of the length 21 and width 22, say, having a lengthwise dimension of about from fourteen to ninety-six inches, for example, about fifty-one and one half inches, and having a widthwise dimension of about from six to forty inches, for example, about thirteen inches. The opening 24 is completely through the thickness 23. Also, bushing holes 26 can be provided to receive the bushings 17B of the movable connectors 17. In addition, permanent mounting parallels 29 can be provided for clamping, say, to set up station 50 or press 60.

Tooling subassembly 30, say, made of unhardened or prehardened steel, has length 31, say, about from ten to ninety inches; width 32, say, about from ten to forty-four inches, for example, about sixteen inches; and thickness 33, say, about from four to ten inches. The tooling subassembly 30 is mounted on an upper portion of the lower die shoe 20, for example, through lower tooling plate 34, which may be any suitable thickness, say, about from one inch to two inches, for example, about from one and one quarter of an inch to one and one half of an inch. The lower tooling plate 34 covers at least a portion of the opening 24 of the lower die shoe 20. Lower tooling plate hole(s) 34H can be provided so that scrap and/or parts may fall therethrough. The tooling subassembly 30 can be mounted on a lower portion of the upper die shoe 10, for example, through upper tooling plate 35, which, too, may be any suitable thickness, say, about from one inch to two inches, for example, about from one and one quarter of an inch to one and one half of an inch. The lower tooling plate 34 and upper tooling plate 35 may have the same shape and be mounted in registry, as it were. Between the lower and upper tooling plates 34, 35 are provided tooling components, which can include components such as stop blocks 36, balance blocks 37, stripper pad 38, lower die steel 39 and so forth.

Set of plural movable supports 40, say, made of prehardened or hardened steel, are provided. Although individual supports 40 can be substantially flat and rectangular as found in FIGS. 6-8 and 10-21, say, about from six to ten inches high by about from six to forty inches wide, for example, about thirteen inches wide, by about from one inch to two inches thick, with major faces 41 facing, they may be in any other suitable array, form and/or shape, for example, looking from the top, in a block array (FIG. 22); in a round form (FIG. 23); in a V-shape, a zigzag shape, a crescent shape, and a serpentine shape (FIGS. 24-27); and so forth. The movable supports 40 can be closely spaced in relation to one another, and the supports 40 can be selected and stationed to support the lower tooling plate 34 and to avoid any of its hole(s) so that scrap and/or parts can fall through the hole(s) of the lower tooling plate 34 and hence fall through the opening 24 in the lower die shoe 20 over which is mounted the tooling subassembly 30 with the lower tooling plate 34. Also, connector/clamping pin mechanism 42 with pin movers 43 may be provided to move or secure the movable supports. In addition, alignment holes 45, say, about one quarter of an inch deep, may be provided in the bottom of each of the movable supports 40.

Set up station 50 can be spaced apart from the stamping site. At the set up station 50, the plural movable supports 40 can be arranged and selected for moving to the device to be stationed as the set of plural movable supports for support of the lower tooling plate of the device. The set up station 50 can include pin movers 53 equivalent to the pin movers 43 can be provided. Also, lower pins 55 can fit in the alignment holes 45 and help hold an unused, i.e., nonoperational, movable support 40 in its proper place at the set up station.

Press 60 can mount the modular die set 100 and modular die 200. With the press 60, parts may be made from the workpiece 8.

Electronic or computer control can be provided to increase efficiency and ameliorate if not avoid mistakes. This may be provided at the set up station 50 especially, and the press 60.

Operation may be carried out in any suitable manner. Compare, FIG. 28.

TABLE

| FIG. NO. | Note |
|---|---|
| 10 | E.g., 15.750" max. shut height with 12.125" min. shut height for upper die shoe 10. |
| 11 | E.g., Dowel pins stick up out of master hole shoe for locations in sub-plates. Mill hole in sub-plate. Dowel pins should stick out of sub-plate, and then the holes will be in receiver plate. Make the pins 1/2 dia. Dowel pins may be 5/8" dia. Dowel pins' center pin is 4-way. Outer two pins are both 2-way. |
| 12 | Continue to hold latch out while picking up -- while it is being picked up. |
| 13 | Make it so that, when attaching parallels, they are lifted up slightly. e.g., so that the pins are easy to push in and out -- e.g., if spring loaded, may crash when coming back to setup station. |

CONCLUSION

The present invention is thus provided. Various feature(s), part(s), step(s), subcombination(s) and/or combination(s) can be employed in the practice of the invention with other feature (s), part(s), step(s), subcombination(s) and/or combination (s), and numerous and sundry adaptations and modifications can be effected by those skilled in the art within its spirit, the literal claim scope of which is particularly pointed out as follows:

I claim:

1. A method for making parts comprising the steps, not necessarily conducted in series, of:

providing a modular die set for die stamping parts, the modular die set for die stamping parts including:

an upper shoe die a lower die shoe having a first length, width, and thickness, and an opening spanning a substantial, extensive portion of the first length and width of the lower die shoe, wherein material can pass freely through the opening of the lower die shoe, and said opening defines a perimeter; and a set of plural movable supports, which can be closely spaced or spaced apart in relation to one another, which can be selected and stationed to support a tooling subassembly and to avoid any hole(s) in a lower tooling plate of the tooling subassembly such that scrap and/or parts to fall through the hole(s) can fall through said opening of the lower die shoe, wherein said plural movable supports are positioned during operation within the perimeter of said opening; and extend beyond the thickness of the lower die shoe to a base beneath said lower die shoe to provide the support of the tooling subassembly on the base;

providing the tooling subassembly, and mounting it on the upper and lower die shoes;

selecting from among the set of plural movable supports an operational set of plural movable supports for supporting the lower tooling plate of the tooling subassembly and avoiding any hole(s) therein, and stationing the operational set of plural movable supports under the lower tooling plate such that the lower tooling plate is supported and any scrap and/or parts can pass through any hole(s) in the lower tooling plate and pass through said opening in the lower die shoe;

providing a die with the modular die set for stamping parts, the tooling subassembly, and the selected and stationed operational set of plural movable supports;

providing a press, and mounting the die within the press; and providing a workpiece, and feeding the workpiece through the die in the press while operating the press to make parts from the workpiece through die stamping.

2. The method of claim 1, wherein a set up station spaced apart from the press is further provided, at which the plural movable supports can be selected and arranged for moving to the modular die to be stationed within the perimeter of the opening of the lower die shoe.

3. A modular die set for die stamping parts, comprising:

an upper die shoe;

a lower die shoe having a first length, width, and thickness, and an opening spanning a substantial, extensive portion of the first length and width of the lower die shoe, wherein material can pass freely through the opening of the lower die shoe, and said opening defines a perimeter; and a set of plural movable supports, which can be closely spaced or spaced apart in relation to one another, which can be selected and stationed to support a tooling subassembly and to avoid any hole(s) in a lower tooling plate of the tooling subassembly such that scrap and/or parts to fall through the hole(s) can fall through said opening of the lower die shoe, wherein said plural movable supports are positioned during operation within the perimeter of said opening; and extend beyond the thickness of the lower die shoe to a base beneath said lower die shoe to provide the support of the tooling subassembly on the base.

4. The modular die set of claim 3, wherein the tooling subassembly is present and includes an upper tooling plate and a lower tooling plate with a second length, width, and thickness, for mounting under the upper die shoe and upon the lower die shoe, and the lower tooling plate covers at least a portion of said opening of the lower die shoe, so as to make up a modular die.

5. The modular die set of claim 4, wherein the modular die is mounted within a press such that parts can be made therewith.

6. The modular die set of claim 5, wherein the modular die can be set up at a set up station spaced apart from the press, at which the plural movable supports can be selected and arranged for moving to the modular die to be stationed within the perimeter of the opening of the lower die shoe.

7. The modular die set of claim 6, wherein a connector/clamping pin mechanism with a first set of pin movers is provided for moving or securing the plural movable supports.

8. The modular die set of claim 7, wherein the set up station includes a second set of pin movers corresponding to the first set of pin movers of the connector/clamping pin mechanism.

9. The modular die set of claim 6, wherein alignment holes in bottoms of the movable supports are provided.

10. The modular die set of claim 9, wherein the set up station includes lower pins that can fit in the alignment holes in bottoms of the movable supports and help hold an unused, nonoperational, individual movable support in place at the set up station.

11. The modular die set of claim 5, wherein a connector/clamping pin mechanism with pin movers is provided for moving or securing the plural movable supports.

12. The modular die set of claim 4, wherein a connector/clamping pin mechanism with pin movers is provided for moving or securing the plural movable supports.

13. The modular die set of claim 3, wherein the set of plural movable supports include substantially flat and rectangular individual movable supports, which are less in thickness than in height and width and that generally define outer height and width boundaries for major faces, wherein the individual support pieces are provided in a face to face orientation.

14. The modular die set of claim 13, wherein the individual movable supports are about from six to ten inches high and about from six to forty inches wide and about from one inch to two inches thick.

15. The modular die set of claim 13, wherein a connector/clamping pin mechanism with pin movers is provided for moving or securing the plural movable supports.

16. The modular die set of claim 3, wherein the set of plural movable supports include individual movable supports that can form a "checkerboard" array.

17. The modular die set of claim 16, wherein the individual movable supports are selected from the group consisting of, looking from a top view: a rectangular shape, a square shape, an elliptical shape, and a cylindrical shape.

18. The modular die set of claim 3, wherein the set of plural movable supports include individual movable supports selected from the group consisting of, looking from a top view: a V-shape, a zigzag shape, a crescent shape, and a serpentine shape.

19. The modular die set of claim 3, wherein a connector/clamping pin mechanism with pin movers is provided for moving or securing the plural movable supports.

20. The modular die set of claim 3, wherein alignment holes in bottoms of the movable supports are provided.

* * * * *